US010814465B2

(12) United States Patent
Pelletier et al.

(10) Patent No.: US 10,814,465 B2
(45) Date of Patent: Oct. 27, 2020

(54) SAFETY DEVICE FOR TACKERS

(71) Applicant: Stanley Black & Decker, Inc., New Britain, CT (US)

(72) Inventors: Thomas Pelletier, Wallingford, CT (US); Rachel Lai, Changhua (TW); Daniel Yip, Changhua (TW)

(73) Assignee: Stanley Black & Decker, Inc., New Britain, CT (US)

( * ) Notice: Subject to any disclaimer, the term of this patent is extended or adjusted under 35 U.S.C. 154(b) by 594 days.

(21) Appl. No.: 15/076,715

(22) Filed: Mar. 22, 2016

(65) Prior Publication Data

US 2017/0274511 A1 Sep. 28, 2017

(51) Int. Cl.
*B25C 1/00* (2006.01)
*B25C 5/06* (2006.01)

(52) U.S. Cl.
CPC ..... *B25C 1/008* (2013.01); *B25C 5/06* (2013.01)

(58) Field of Classification Search
CPC ..... B25C 1/008; B25C 5/00; B25C 1/08
USPC ..... 227/8, 156, 130, 142, 10
See application file for complete search history.

(56) References Cited

U.S. PATENT DOCUMENTS 2,117,741 A 5/1938 Polzer
2,537,601 A * 1/1951 Peterson ..... B25D 1/005 227/133
2,775,764 A 1/1957 Maynard
3,572,572 A 3/1971 Readyhough et al.
4,197,974 A 4/1980 Morton et al.
4,265,320 A * 5/1981 Tanaka ..... B25B 23/147 173/178
4,319,705 A 3/1982 Geist et al.
4,405,073 A 9/1983 Escalante
4,552,296 A * 11/1985 Sheng ..... B25C 5/06 227/109
4,784,308 A 11/1988 Novak et al.
5,428,197 A * 6/1995 McCurry ..... B25F 5/00 200/302.1
5,692,665 A 12/1997 Lee
5,695,108 A 12/1997 Lee
(Continued)

FOREIGN PATENT DOCUMENTS

DE 4442657 6/1995
DE 29711755 9/1997
(Continued)

OTHER PUBLICATIONS

European Search Report dated Oct. 12, 2017.

*Primary Examiner* — Thanh K Truong
*Assistant Examiner* — Patrick B Fry
(74) *Attorney, Agent, or Firm* — Gabriel A. Haboubi

(57) ABSTRACT

A safety device for tackers includes a safety slide slidably connected to the outlet of the tacker and the safety slide has a stop protruding from the inside thereof. The rod has one end contacts the stop and the other end of the rod has a plastic tip connected thereto. An ignition spring is connected between the plastic tip and a safety switch. A recovery spring is connected to another position of the rod to position the rod. The safety slide is slidably connected to grooves of the tacker. When the safety slide contacts against an object to be stapled, the rod is pushed by the stop and activates the ignition spring to activate the safety switch so as to reduce the impact of the rod and the safety switch.

10 Claims, 7 Drawing Sheets

(56) References Cited

U.S. PATENT DOCUMENTS 5,735,444 A * 4/1998 Wingert ..... B25C 5/00 227/119
5,799,832 A 8/1998 Chen
5,873,509 A 2/1999 Liao
5,918,790 A * 7/1999 Donnell ..... B25C 7/00 227/119
6,012,622 A * 1/2000 Weinger ..... B25C 1/005 227/10
6,076,720 A 6/2000 Deng
6,082,604 A 7/2000 Dennis
6,257,477 B1 7/2001 Straat et al.
6,267,284 B1 7/2001 Clark
6,279,808 B1 8/2001 Larson
6,357,647 B1 * 3/2002 Ou ..... B25C 1/008 227/10
6,557,744 B2 5/2003 Kitamura
6,557,745 B2 * 5/2003 Wang ..... B25C 1/008 227/142
6,598,776 B2 7/2003 Adachi et al.
6,651,862 B2 11/2003 Driscoll et al.
6,715,657 B2 4/2004 Chen
6,695,197 B2 9/2004 Johansson
6,789,718 B2 9/2004 Canlas et al.
6,808,101 B2 10/2004 Laubach et al.
6,837,412 B2 1/2005 Lamb
6,938,812 B2 9/2005 Miller et al.
6,974,067 B2 12/2005 Chen
7,004,367 B1 * 2/2006 Shen ..... B25C 1/008 173/170
7,011,242 B2 3/2006 Barlow et al.
7,086,573 B1 8/2006 Wen
RE39,567 E 4/2007 Larsen
7,284,685 B1 10/2007 Wojcicki
7,314,155 B2 1/2008 Moeller et al.
7,484,647 B2 * 2/2009 Yang ..... B25C 1/008 227/129
7,559,447 B2 7/2009 Chen et al.
7,628,304 B2 12/2009 Yamamoto et al.
7,726,533 B2 6/2010 Wojcicki
7,757,920 B2 * 7/2010 Shea ..... B25C 1/08 227/119
7,766,204 B2 8/2010 Spasov et al.
7,918,374 B2 4/2011 Gardner et al.
7,971,767 B2 7/2011 Komazaki et al.
8,091,752 B2 1/2012 Jian et al.
8,220,687 B2 7/2012 Yamamoto et al.
8,322,006 B1 12/2012 Kodi
8,408,438 B2 * 4/2013 Taylor ..... B25C 1/008 227/142
8,413,867 B2 4/2013 Gardner et al.
8,430,290 B2 4/2013 Tebo
8,631,986 B2 * 1/2014 Hlinka ..... B25C 1/06 173/11
8,695,860 B2 4/2014 Wang et al.
8,985,424 B2 3/2015 Miyashita
2003/0222115 A1 * 12/2003 Chen ..... B25C 5/1665 227/127
2005/0194421 A1 * 9/2005 Smolinski ..... B25C 7/00 227/140
2005/0224555 A1 10/2005 Kirby et al.
2007/0090149 A1 4/2007 Segura
2008/0017689 A1 1/2008 Simonelli
2008/0264999 A1 10/2008 Lee
2009/0145946 A1 6/2009 Ebihara
2010/0187278 A1 * 7/2010 Lin ..... B25C 1/008 227/8
2011/0132959 A1 * 6/2011 Hlinka ..... B25C 1/008 227/8
2012/0043366 A1 2/2012 Wang et al.
2012/0261456 A1 10/2012 Lacy et al.
2013/0292446 A1 4/2013 Choy
2013/0153621 A1 6/2013 Franz
2013/0221056 A1 8/2013 Chen
2014/0175145 A1 2/2014 Wang et al.
2014/0175144 A1 * 6/2014 Chen ..... B25C 5/08 227/87
2014/0319196 A1 10/2014 Huang
2015/0014388 A1 1/2015 Moriwaki et al.
2015/0048138 A1 2/2015 Chen et al.
2015/0202757 A1 7/2015 Smeaton et al.
2015/0224637 A1 8/2015 Wolf et al.
2015/0314433 A1 11/2015 Fleischer et al.
2015/0352703 A1 12/2015 Wu
2018/0093370 A1 * 4/2018 Yip ..... B25C 1/008

FOREIGN PATENT DOCUMENTS

EP 0987086 3/2000
EP 1122043 8/2001
EP 1188523 3/2002
EP 1260321 11/2002
EP 1263551 12/2002
EP 1053080 2/2003
EP 1364750 11/2003
EP 1539432 4/2004
EP 1621291 2/2006
EP 1741519 1/2007
EP 1812207 8/2007
EP 1832390 9/2007
EP 1930126 6/2008
EP 2450153 5/2012
EP 2485872 8/2012
EP 2604389 6/2013
EP 2660010 11/2013
EP 2734338 5/2014
EP 2762275 8/2014
EP 2792453 10/2014
EP 2837470 2/2015
EP 2842695 3/2015
EP 2861380 4/2015
EP 2885110 6/2015

* cited by examiner

SAFETY DEVICE FOR TACKERS

BACKGROUND OF THE INVENTION

1. Fields of the Invention

The present invention relates to a safety device for a tacker, and more particularly, to a safety device including an ignition spring connected to the plastic tip on the rod and the ignition spring precisely contacts the safety switch.

2. Descriptions of Related Art

The conventional power tacker is disclosed in FIGS. 5 to 8, and generally comprises body 70 with an operation path 71 defined therein. A safety device 80 includes a rod 81 which is movably received in the operation path 71 and has a first end extending beyond an outlet 72 of the body 70 of the tacker. The first end is used to contact against an object to be stapled. A recovery spring 82 is connected to mediate portion of the rod 81 and positioned in a space 73 in the body 70 so as to provide a resilient recovery force to allow the rod to move back to its initial position. A plastic member 83 is connected to a second end of the rod 81 and has an extension 84 which is an inclined part. The inclined extension 84 is used to touch or activate a contact plate 91 of a safety switch 90. When the user pushes the first end of the rod 81 against the object to be stapled, the rod 81 is pushed backward and the extension 84 pushes the contact plate 91 of the safety switch 90 to send a signal to let one staple to be stapled to the object.

However, the extension 84 is usually made by plastic which may become fragile or deformed after a period of time of use, and this may not precisely activate the safety switch 90.

Besides, when the object to be stapled is thin and which means that the displacement of movement of the rod 81 cannot move the extension a sufficient distance to effectively activate the contact plate 91 of the safety switch 90 as shown in FIG. 7. Therefore, the stapling action may fail.

Furthermore, the conventional rod 81 does not have a proper index portion at the first end thereof so that the user may not notice that the stapling position is not at the desired position. This happens frequently when stapling a cable, and the sheath of the cable is broken.

After each stapling action, the rod 81 returns quickly and the extension 84 may hit the contact plate 91 of the safety switch 90 and even damage the safety switch 90.

The present invention intends to provide a safety device for a tacker, and includes an ignition spring connected to the plastic tip on the rod so as to precisely contact the safety switch and to eliminate the shortcomings mentioned above.

SUMMARY OF THE INVENTION

The present invention relates to a safety device for a tacker, and comprises a body having an outlet at the front end thereof, and an operation path is defied in the body and communicates with the outlet so as to receive a rod therein. The rod has a contact portion formed at the first end thereof, and a connection portion is formed at the mediate portion of the rod. A recovery spring is mounted to the connection portion to provide a recovery force to the rod. A seat is formed at the second end of the rod and has a plastic tip extending therefrom.

A safety slide is a U-shaped plate and has two wings. The safety slide is slidably mounted to the front end of the body and located corresponding to the outlet of the body. The safety slide has a bottom edge formed at the distal end thereof. An index portion is formed at the safety slide. A stop extends from the bottom of the safety slide and is located corresponding to the contact portion of the rod. When the safety slide is slid, the stop contacts the contact portion and drives the rod to be retracted into the body. An ignition spring is mounted to the plastic tip of the seat. A safety switch is located in the body and has a contact plate extending therefrom. The contact plate is pushed by the ignition spring to send a stapling signal when the rod is retracted back into the body.

Preferably, the index portion includes a side index portion on each of the two wings of the safety slide.

Preferably, the index portion includes a front index portion on the top of the safety slide.

Preferably, a notch is defined in the bottom edge of the safety slide.

Preferably, the plastic tip is located at the distal end of the seat and movable with the rod in the axial direction of the rod.

Preferably, the contact plate of the safety switch is pushed by the ignition spring.

The present invention provides the recovery spring and the ignition spring, the two springs absorb impact so that the rod does not hit the safety switch hardly.

The contact plate of the safety switch is pushed by the ignition spring so that even if the object to be stapled is thin, the contact plate can be activated by the ignition spring.

The user can check the position that the staples will be stapled on the object by the side and front index portions. The notch of the safety slide ensures that the cable to be stapled is secured.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
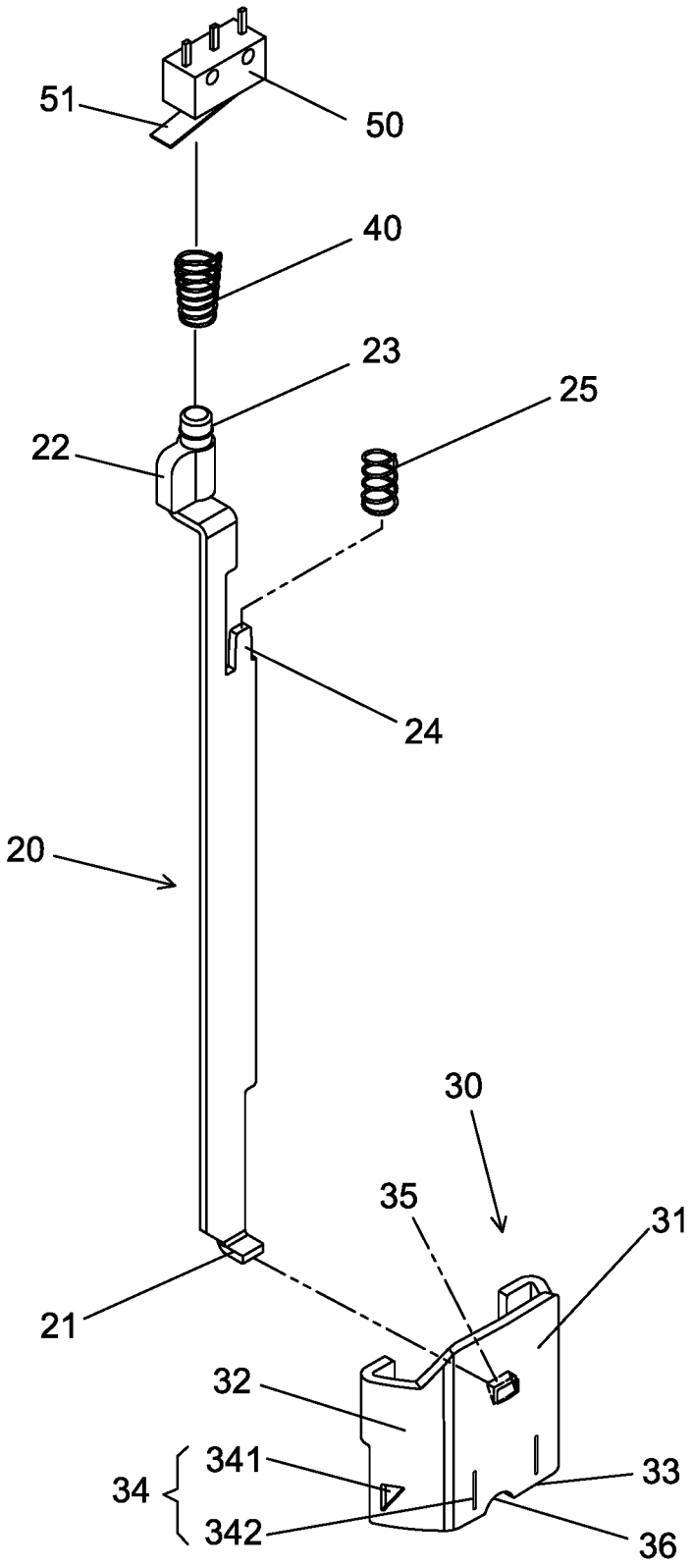
FIG. 1 shows the rod, the safety slide, and the safety switch of the safety device of the present invention.
Figure 2:
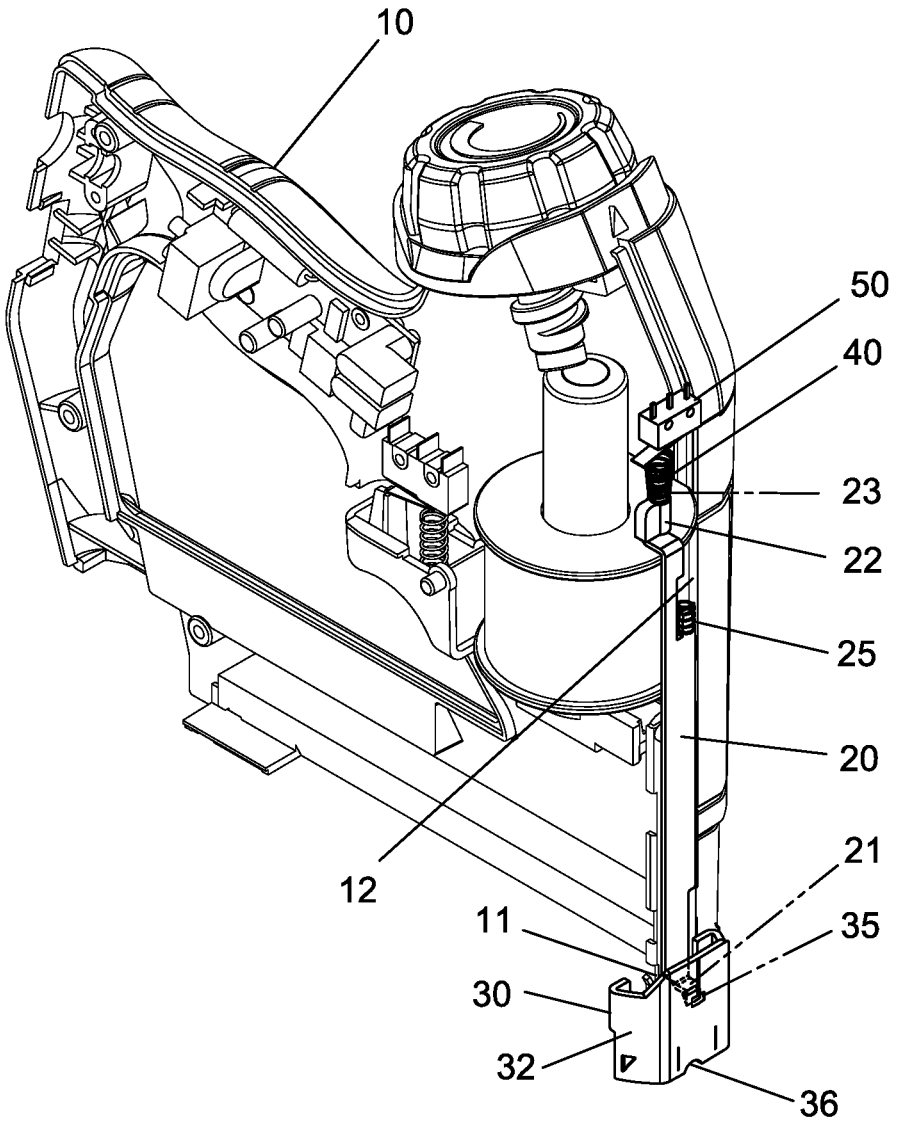
FIG. 2 is a perspective view to show the safety device of the present invention installed in a tacker.

Referring to FIGS. 1 and 2, the safety device of the present invention comprises a body 10 having an outlet 11 defined through the front end thereof, and an operation path 12 is defied in the body 10 and communicates with the outlet 11. A rod 20 is movably located in the operation path 12 and has a contact portion 21 formed at the first end thereof. A seat 22 is formed at the second end of the rod 20 and has a plastic tip 23 extending therefrom. A recessed area is defined in one side of the mediate portion of the rod 20 and a connection portion 24 is formed at the recessed area. The connection portion 24 extends along the axial direction of the rod 20. A recovery spring 25 is mounted to the connection portion 24 to provide a recovery force to the rod 20.

Figure 4:
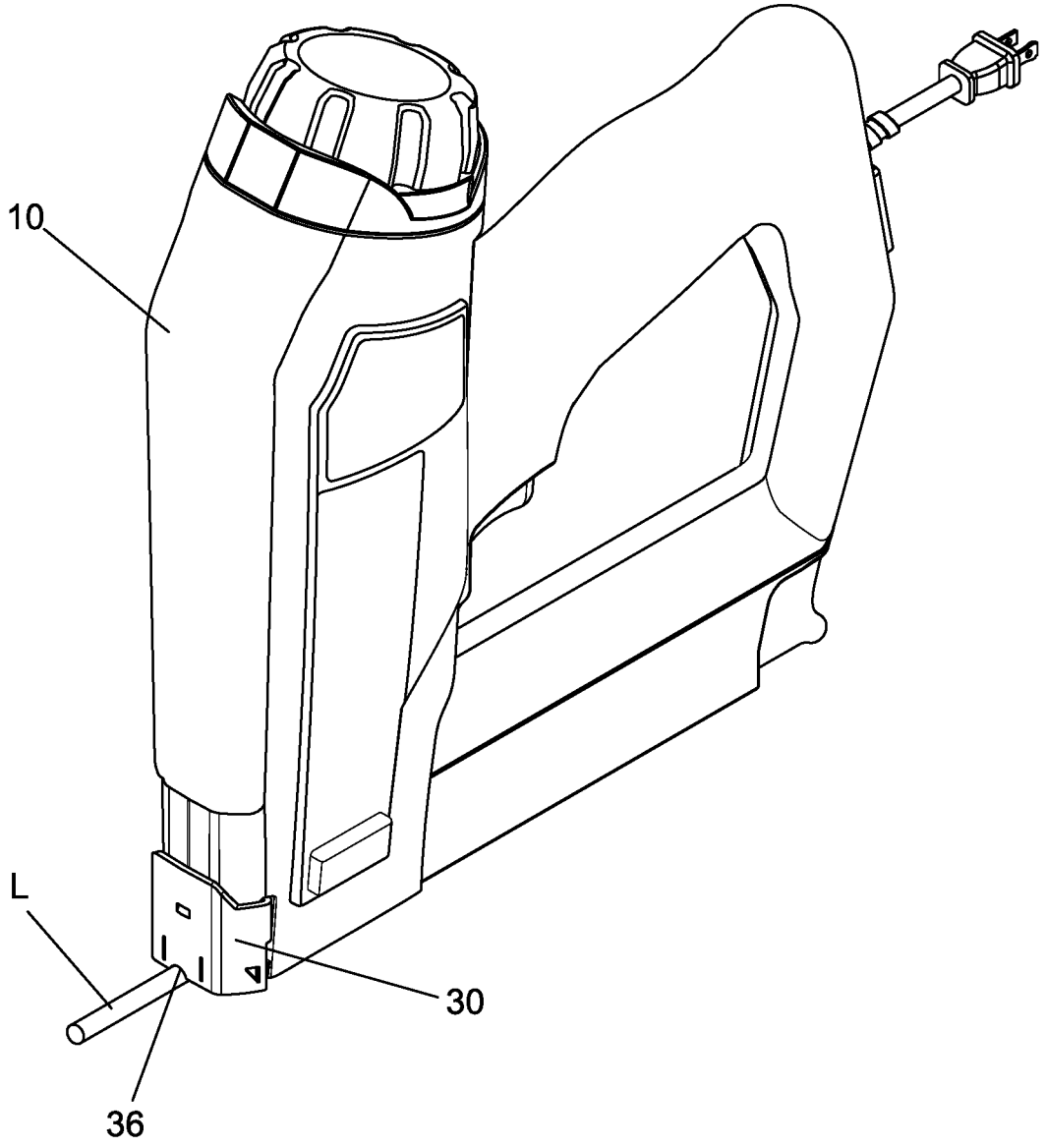
FIG. 4 shows that a cable to be stapled is positioned by the notch of the safety slide of the present invention.
Figure 5:
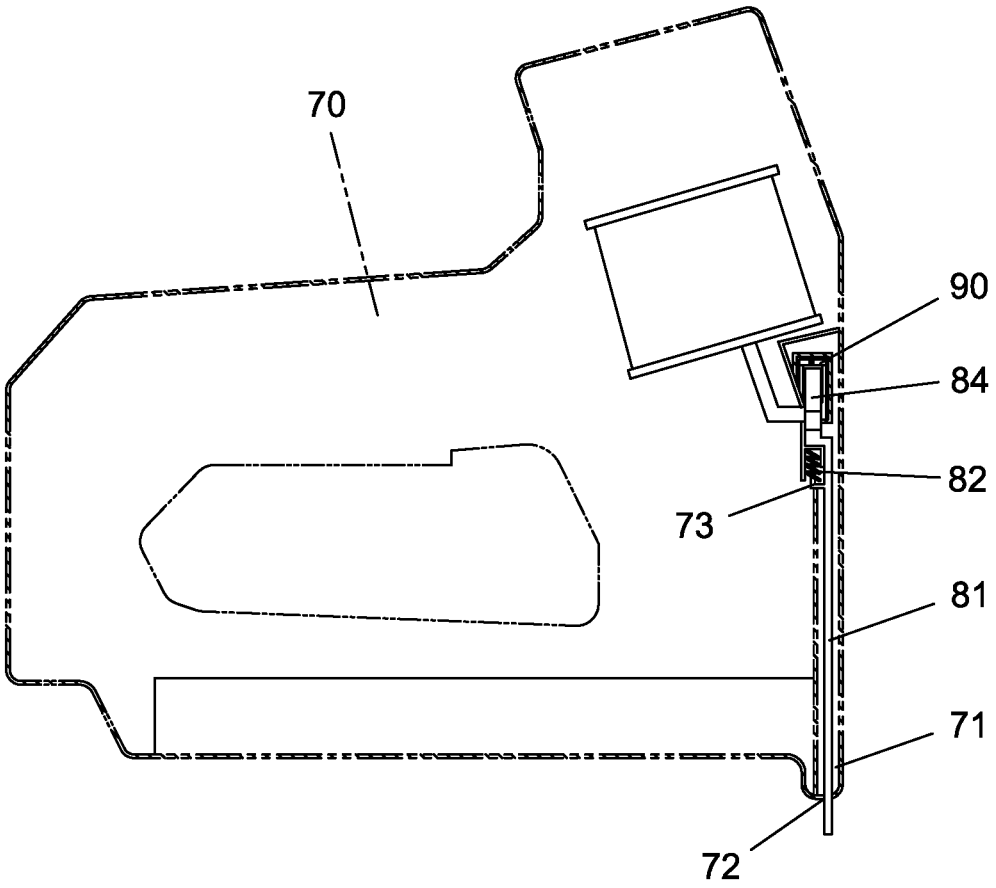
FIG. 5 PRIOR ART
FIG. 5 shows a conventional safety device installed in a tacker.
Figure 6:
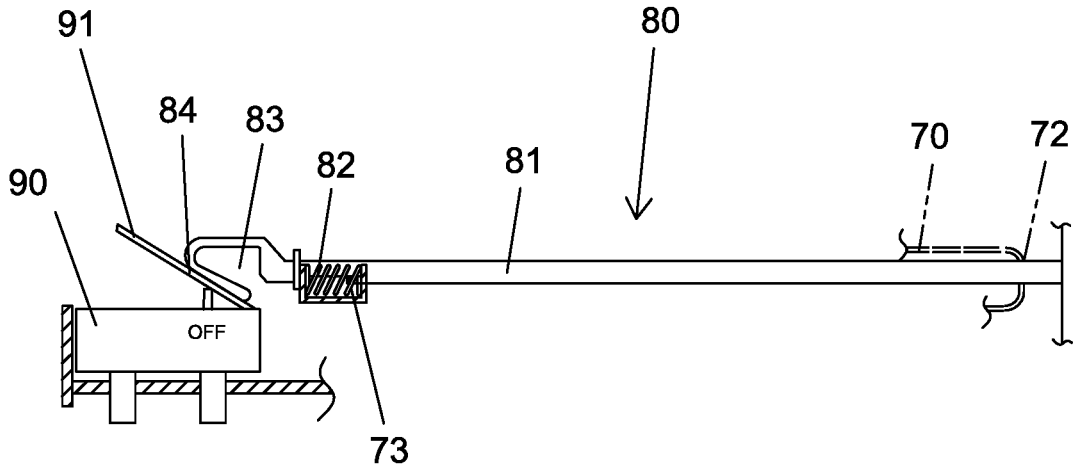
FIG. 6 PRIOR ART
FIG. 6 illustrates that the rod of the conventional safety device is about to contact against an object to be stapled.
Figure 7:
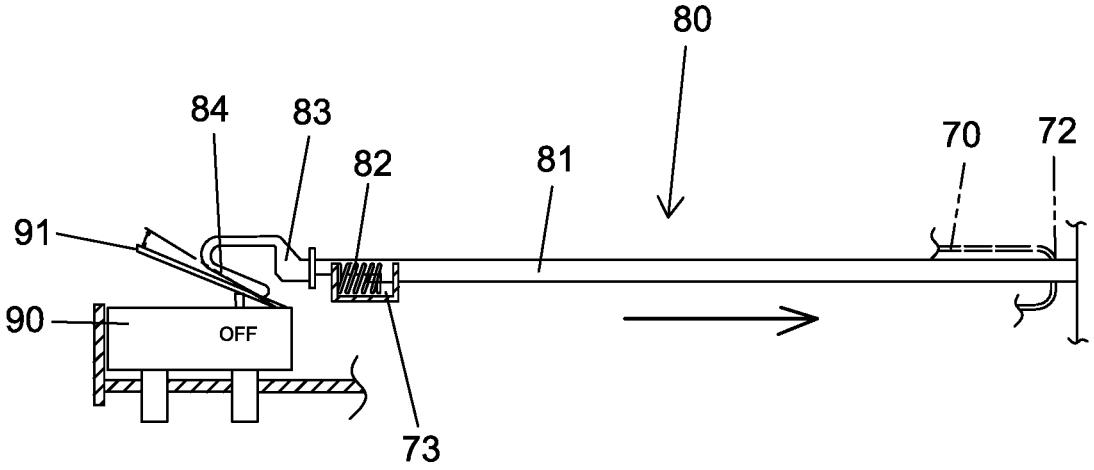
FIG. 7 PRIOR ART
FIG. 7 illustrates that the rod of the conventional safety device contacts a thin object to be stapled.
Figure 8:
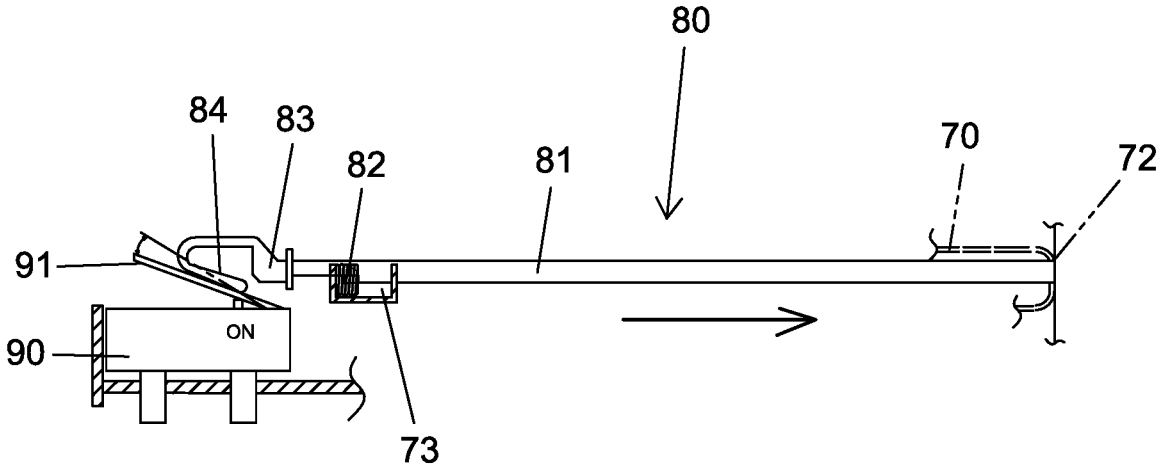
FIG. 8 PRIOR ART
FIG. 8 illustrates that the rod of the conventional safety device begins to move toward contacts against the object to be stapled.

A safety slide 30 is a U-shaped plate 31 and has two wings 32 extending from two sides thereof that surround a portion of the front end of the body 10 and extend into the body 10. The safety slide 30 is slidably mounted to the front end of the body 10 and located corresponding to the outlet 11 of the body 10. The safety slide 30 has a bottom edge 33 formed at the distal end thereof so as to contact against an object to be stapled. A notch 36 is defined in the bottom edge 33 of the safety slide 30 so as to secure a cable "L" as shown in FIG. 4 to be stapled. The shape and size of the notch 36 can be varied according to the cable "L" to be secured. An index portion 34 formed at the safety slide 30. The index portion 34 includes a side index portion 341 on each of the two wings 32 of the safety slide 30, and a front index portion 342 on the top of the safety slide 30. A stop 35 extends from the bottom of the safety slide 30 and is located corresponding to the contact portion 21 of the rod 20. An ignition spring 40 is mounted to the plastic tip 23 of the seat 22. The plastic tip 23 is located at the distal end of the seat 22 and movable with the rod 20 in the axial direction of the rod 20. A safety switch 50 is located in the body 10 and has a contact plate 51 extending therefrom. The contact plate 51 is pushed by the ignition spring 40 to send a stapling signal to the related electrical means of the tacker when the rod 20 is retracted back into the body 10. It is noted that the contact plate 51 of the safety switch 50 is pushed by the ignition spring 40 which is moved along the axial direction of the rod 20.

Figure 3:
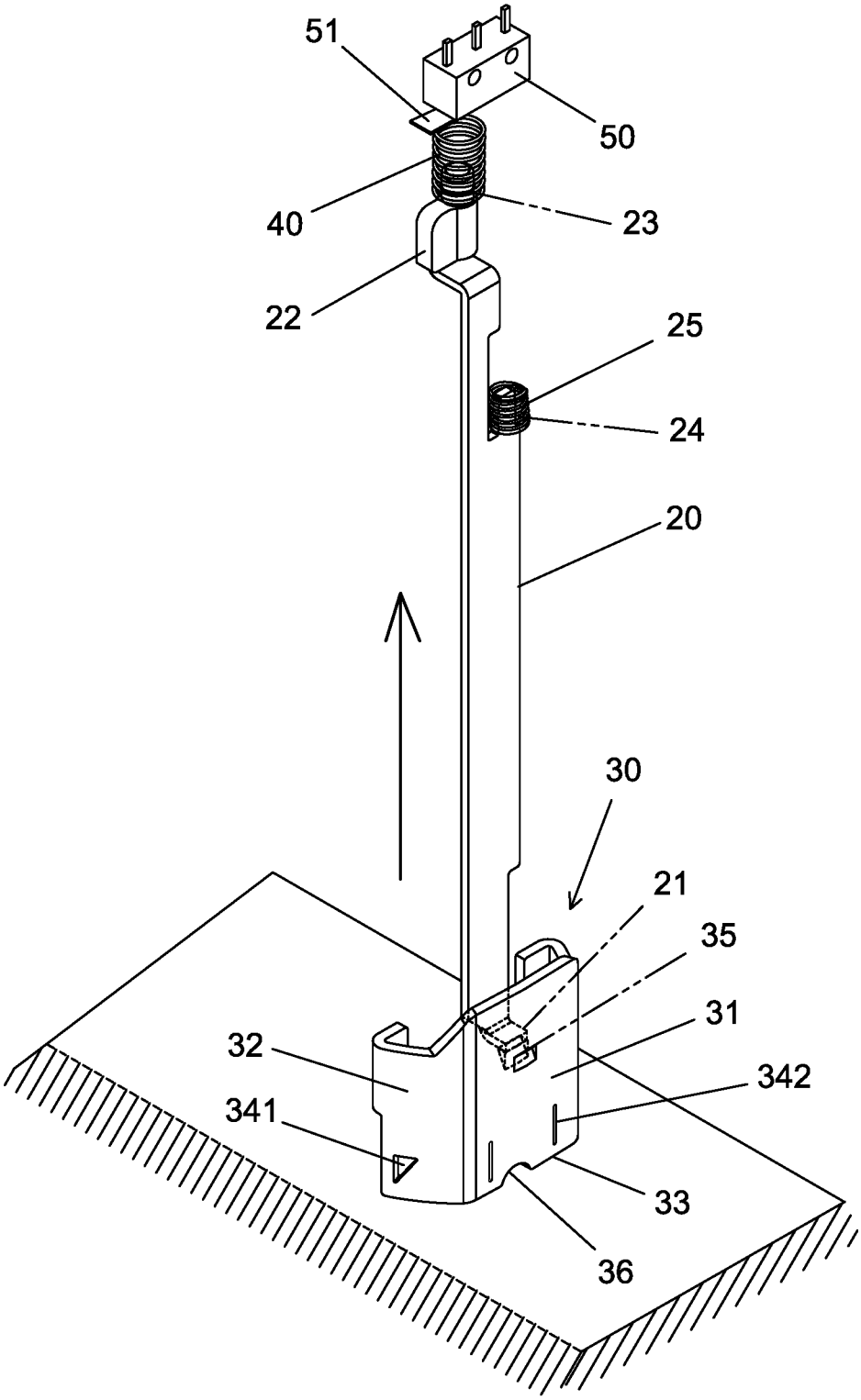
FIG. 3 shows that the rod is pushed against an object to be stapled and the rod is pushed backward.

As shown in FIG. 3, when the tacker is used to staple an object, the safety slide 30 is pushed against the object and slid upward, the stop 35 contacts the contact portion 21 and drives the rod 20 to be retracted into the body 10. The rod 20 moves backward and the ignition spring 40 is movable with the rod 20 and activates the contact plate 51 of the safety switch 50 so that a stapling signal is sent and the staple is ejected.

The ignition spring 40 is compressible so that when it touches the contact plate 51 of the safety switch 50, the compression of the ignition spring 40 absorbs a certain level of impact applied to the safety switch 50. This feature also prevent the plastic tip 23 from being damaged. The ignition spring 40 pushes the contact plate 51 along the axial direction of the rod 20 so that even if the object is thin, the safety switch 50 is activated properly.

The present invention provides the recovery spring 25 and the ignition spring 40, the two springs 25, 40 absorb impact so that the rod 20 does not hit the safety switch 50 hardly.

The user can check the position that the staples will be stapled on the object by the side and front index portions 341, 342 to prevent incorrectly stapling. The notch 36 of the safety slide 30 ensures that the cable "L" to be stapled is secured.

While we have shown and described the embodiment in accordance with the present invention, it should be clear to those skilled in the art that further embodiments may be made without departing from the scope of the present invention.

What is claimed is:

1. A safety device for a tacker configured to eject a staple, comprising:

a body having an outlet defined through a front end thereof, and enclosing staple ejection electronics and an operation path defied in the body, the operation path communicating with the outlet;

a rod movably located in the operation path and having a contact portion formed at a first end thereof, a connection portion formed at a mediate portion of the rod, a recovery spring mounted to the connection portion to provide a recovery force to the rod, a seat formed at a second end of the rod and having a tip extending therefrom;

a safety slide being a U-shaped plate and having two wings extending from two sides thereof, the safety slide slidably mounted to an exterior of the front end of the body and located corresponding to the outlet of the body such that the two wings surround a portion of the front end of the body and extend into the body, the safety slide having a U-shaped bottom edge formed at a distal end thereof, a stop extending from the safety slide and located corresponding to the contact portion of the rod, when the safety slide is slid, the stop contacts the contact portion and drives the rod to be retracted into the body;

an ignition spring mounted to the tip of the seat, and a safety switch located in the body and having a contact plate extending therefrom, the contact plate being pushed by the ignition spring to send a tacking signal when the rod is retracted back into the body;

wherein the U-shaped bottom edge of the safety slide and a portion of the body extending parallel to the U-shaped bottom edge of the safety slide are configured to extend adjacent to an object that will receive an ejected staple;

wherein the safety slide is pressed onto the object that will receive the ejected staple until the body makes contact with the object that will receive the ejected staple, said pressing of the safety slide causing the contact plate of the safety switch to be pushed; and wherein contact between the object that will receive the ejected staple and the safety slide is visible from the exterior of the front end of the body.

2. The safety device for a tacker as claimed in claim 1, wherein an index portion formed at the safety slide includes a side index portion on each of the two wings of the safety slide.

3. The safety device for a tacker as claimed in claim 1, wherein an index portion formed at the safety slide includes a front index portion on a front of the safety slide.

4. The safety device for a tacker as claimed in claim 1, wherein a notch is defined in the bottom edge of the safety slide.

5. The safety device for a tacker as claimed in claim 1, wherein the tip is located at a distal end of the seat and movable with the rod in an axial direction of the rod.

6. The safety device for a tacker as claimed in claim 1, wherein the contact plate of the safety switch is pushed by the ignition spring which is moved along an axial direction of the rod.

7. A tacker configured to eject a staple, comprising:

a body having an outlet defined through a front end thereof, and enclosing staple ejection electronics and an operation path defied in the body, the operation path communicating with the outlet a rod movably located in the operation path and having a contact portion formed at a first end thereof;

a safety slide being a U-shaped plate and having two wings extending from two sides thereof, the safety slide slidably mounted to an exterior of the front end of the body and located corresponding to the outlet of the body such that the two wings surround a portion of the front end of the body and extend into the body, the safety slide having a U-shaped bottom edge formed at a distal end thereof, a stop extending from the safety slide and located corresponding to the contact portion of the rod, when the safety slide is slid, the stop contacts the contact portion and drives the rod to be retracted into the body;

a safety switch located in the body and having a contact plate extending therefrom, the contact plate being pushed to send a tacking signal when the rod is retracted back into the body;

wherein the U-shaped bottom edge of the safety slide and a portion of the body extending parallel to the U-shaped bottom edge of the safety slide are configured to extend adjacent to an object that will receive an ejected staple;

wherein the safety slide is pressed onto the object that will receive the ejected staple until the body makes contact with the object that will receive the ejected staple, said pressing of the safety slide causing the contact plate of the safety switch to be pushed; and wherein contact between the object that will receive the ejected staple and the safety slide is visible from the exterior of the front end of the body.

8. The safety device for a tacker as claimed in claim 7, wherein an index portion formed at the safety slide includes a side index portion on each of the two wings of the safety slide.

9. The safety device for a tacker as claimed in claim 7, wherein an index portion formed at the safety slide includes a front index portion on a front of the safety slide.

10. The safety device for a tacker as claimed in claim 7, wherein a notch is defined in the bottom edge of the safety slide.

* * * * *